US010388288B2

(12) United States Patent
Zhang et al.

(10) Patent No.: US 10,388,288 B2
(45) Date of Patent: Aug. 20, 2019

(54) METHOD AND APPARATUS FOR DETERMINING INTER-CHANNEL TIME DIFFERENCE PARAMETER

(71) Applicant: Huawei Technologies Co., Ltd., Shenzhen (CN)

(72) Inventors: Xingtao Zhang, Shenzhen (CN); Lei Miao, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 15 days.

(21) Appl. No.: 15/696,716

(22) Filed: Sep. 6, 2017

(65) Prior Publication Data

US 2017/0365265 A1 Dec. 21, 2017

Related U.S. Application Data

(63) Continuation of application No. PCT/CN2015/095090, filed on Nov. 20, 2015.

(30) Foreign Application Priority Data

Mar. 9, 2015 (CN) ..... 2015 1 0103379

(51) Int. Cl.
*G10L 19/008* (2013.01)

(52) U.S. Cl.
CPC ..... *G10L 19/008* (2013.01)

(58) Field of Classification Search
CPC ..... G10L 19/008; G10L 25/06; G10L 25/45
See application file for complete search history.

(56) References Cited

U.S. PATENT DOCUMENTS 6,584,441 B1 6/2003 Ojala et al.
8,077,893 B2 12/2011 Roy et al.
8,948,891 B2 2/2015 Lee et al.
(Continued)

FOREIGN PATENT DOCUMENTS

CA 2977846 A1 9/2016
CN 1273663 A 11/2000
(Continued)

OTHER PUBLICATIONS

Oomen, Werner, et al. "Advances in parametric coding for high-quality audio." Audio Engineering Society Convention 114. Audio Engineering Society, 2003. (Year: 2003).*
(Continued)

*Primary Examiner* — Brian L Albertalli
(74) *Attorney, Agent, or Firm* — Slater Matsil, LLP

(57) ABSTRACT

A method and an apparatus for determining an inter-channel time difference parameter are provided, so that precision of a determined ITD parameter can adapt to channel quality. The method includes: determining a target search complexity from plurality of search complexities, where the plurality of search complexities are in a one-to-one correspondence with plurality of channel quality values; and performing search processing on a signal on a first sound channel and a signal on a second sound channel according to the target search complexity so as to determine a first inter-channel time difference ITD parameter corresponding to the first sound channel and the second sound channel.

20 Claims, 4 Drawing Sheets

(56) References Cited

U.S. PATENT DOCUMENTS

| | | | | |
|---|---|---|---|---|
| 9,449,604 | B2 * | 9/2016 | Virette | G10L 19/008 |
| 2002/0123885 | A1 | 9/2002 | Sluijter et al. | |
| 2004/0039464 | A1 | 2/2004 | Virolainen et al. | |
| 2005/0251387 | A1 | 11/2005 | Jelinek et al. | |
| 2006/0069553 | A1 | 3/2006 | Hakansson et al. | |
| 2011/0206223 | A1 * | 8/2011 | Ojala | G10L 19/008 381/300 |
| 2012/0033817 | A1 * | 2/2012 | Francois | G10L 19/008 381/2 |
| 2012/0045067 | A1 | 2/2012 | Oshikiri | |
| 2013/0282384 | A1 | 10/2013 | Gibbs | |
| 2013/0301835 | A1 | 11/2013 | Briand et al. | |
| 2013/0304481 | A1 * | 11/2013 | Briand | G10L 19/008 704/500 |
| 2014/0164001 | A1 * | 6/2014 | Lang | G10L 19/008 704/500 |
| 2015/0010155 | A1 | 1/2015 | Virette et al. | |
| 2016/0078877 | A1 * | 3/2016 | Vasilache | G10L 19/008 381/23 |

FOREIGN PATENT DOCUMENTS

| | | | |
|---|---|---|---|
| CN | 1288557 | A | 3/2001 |
| CN | 1820306 | A | 8/2006 |
| CN | 101073109 | A | 11/2007 |
| JP | H0669811 | A | 3/1994 |
| JP | 2015518176 | A | 6/2015 |
| RU | 2010116295 | A | 11/2011 |
| WO | 2012105885 | A1 | 8/2012 |
| WO | 2010134332 | A1 | 11/2012 |
| WO | 2013149671 | A1 | 10/2013 |
| WO | 2014174344 | A1 | 10/2014 |
| WO | 2016141732 | A1 | 9/2016 |

OTHER PUBLICATIONS

Herre, Jürgen, et al. "MPEG surround—the ISO/MPEG standard for efficient and compatible multichannel audio coding." Journal of the Audio Engineering Society 56.11 (2008): 932-955. (Year: 2008).*

Baumgarte, Frank, and Christof Faller. "Estimation of auditory spatial cues for binaural cue coding." Acoustics, Speech, and Signal Processing (ICASSP), 2002 IEEE International Conference on. vol. 2. IEEE, 2002. (Year: 2002).*

Herre, J., et al. "The reference model architecture for MPEG spatial audio coding." Preprint 118th Conv. Aud. Eng. Soc.. No. LCAV-CONF-2005-031. 2005. (Year: 2005).*

"New Annex F with Stereo embedded extension for ITU-TG.711.1", ITU-T Recommendation G.711.1 Amendment F; Study Period 2009-2012, International Telecommunication Union, XP044050912, May 9, 2012, pp. 1-52, vol. 10/16, Geneua.

Faller, Chritof et al., "Source localization in complex listening situations: Selection of binaural cues based on interaural coherence," J. Acoust. Soc. Am. 116 (5), Nov. 2004, 15 pages.

* cited by examiner

METHOD AND APPARATUS FOR DETERMINING INTER-CHANNEL TIME DIFFERENCE PARAMETER

CROSS-REFERENCE TO RELATED APPLICATIONS

This application is a continuation of International Application No. PCT/CN2015/095090, filed on Nov. 20, 2015, which claims priority to Chinese Patent Application No. 201510103379.3, filed on Mar. 9, 2015. The disclosures of the aforementioned applications are hereby incorporated by reference in their entireties.

TECHNICAL FIELD

The present disclosure relates to the audio processing field, and more specifically, to a method and an apparatus for determining an inter-channel time difference parameter.

BACKGROUND

Improvement in quality of life is accompanied with people's ever-increasing requirements for high-quality audio. Compared with mono audio, stereo audio provides sense of direction and sense of distribution of sound sources and can improve clarity and intelligibility of information, and is therefore highly favored by people.

Currently, there is a known technology for transmitting a stereo audio signal. An encoder converts a stereo signal into a mono audio signal and a parameter such as an inter-channel time difference (ITD), separately encodes the mono audio signal and the parameter, and transmits an encoded mono audio signal and an encoded parameter to a decoder. After obtaining the mono audio signal, the decoder further restores the stereo signal according to the parameter such as the ITD. Therefore, low-bit and high-quality transmission of the stereo signal can be implemented.

In the foregoing technology, based on a sampling rate of an input audio signal, the encoder can determine a limiting value $T_{max}$ of an ITD parameter at the sampling rate, and therefore may perform searching and calculation at a specified step within a search range $[T_{max}, T_{max}]$ based on the input audio signal, to obtain the ITD parameter. Therefore, regardless of channel quality, a same search range and a same search step are used.

However, different channel quality requires different precision of an ITD parameter. For example, relatively poor channel quality requires relatively low precision of an ITD parameter. In this case, if a relatively large search range and a relatively small search step are still used, computing resources are wasted, and processing efficiency is severely affected.

Therefore, a technology is expected to be provided, so that precision of a determined ITD parameter can adapt to channel quality.

SUMMARY

Embodiments of the present disclosure provide a method and an apparatus for determining an inter-channel time difference parameter, so that precision of a determined ITD parameter can adapt to channel quality.

According to a first aspect, a method for determining an inter-channel time difference parameter is provided, where the method includes: determining a target search complexity from a plurality of search complexities, where the plurality of search complexities are in a one-to-one correspondence with a plurality of channel quality values. The method further includes performing search processing on a signal on a first sound channel and a signal on a second sound channel according to the target search complexity so as to determine a first ITD parameter corresponding to the first sound channel and the second sound channel according to the search processing.

With reference to the first aspect, in a first implementation of the first aspect, the determining a target search complexity from a plurality of search complexities includes: obtaining a coding parameter for a stereo signal, where the stereo signal is generated based on the signal on the first sound channel and the signal on the second sound channel, the coding parameter is determined according to a current channel quality value, and the coding parameter includes any one of the following parameters: a coding bit rate, a coding bit quantity, or a complexity control parameter used to indicate the search complexity; and determining the target search complexity from the plurality of search complexities according to the coding parameter.

With reference to the first aspect and the foregoing implementation of the first aspect, in a second implementation of the first aspect, the plurality of search complexities are in a one-to-one correspondence with a plurality of search steps, the plurality of search complexities include a first search complexity and a second search complexity, the plurality of search steps include a first search step and a second search step, the first search step corresponding to the first search complexity is less than the second search step corresponding to the second search complexity, and the first search complexity is higher than the second search complexity; and the performing search processing on a signal on a first sound channel and a signal on a second sound channel according to the target search complexity includes: determining a target search step corresponding to the target search complexity; and performing search processing on the signal on the first sound channel and the signal on the second sound channel according to the target search step.

With reference to the first aspect and the foregoing implementation of the first aspect, in a third implementation of the first aspect, the plurality of search complexities are in a one-to-one correspondence with a plurality of search ranges, the plurality of search complexities include a third search complexity and a fourth search complexity, the plurality of search ranges include a first search range and a second search range, the first search range corresponding to the third search complexity is greater than the second search range corresponding to the fourth search complexity, and the third search complexity is higher than the fourth search complexity; and the performing search processing on a signal on a first sound channel and a signal on a second sound channel according to the target search complexity includes: determining a target search range corresponding to the target search complexity; and performing search processing on the signal on the first sound channel and the signal on the second sound channel within the target search range.

With reference to the first aspect and the foregoing implementation of the first aspect, in a fourth implementation of the first aspect, the determining a target search range corresponding to the target search complexity includes: determining a reference parameter according to a time-domain signal on the first sound channel and a time-domain signal on the second sound channel, where the reference parameter is corresponding to a sequence of obtaining the time-domain signal on the first sound channel and the time-domain signal on the second sound channel, and the time-domain signal on the first sound channel and the time-domain signal on the second sound channel are corresponding to a same time period; and determining the target search range according to the target search complexity, the reference parameter, and a limiting value $T_{max}$, where the limiting value $T_{max}$ is determined according to a sampling rate of the time-domain signal on the first sound channel, and the target search range falls within $[-T_{max}, 0]$, or the target search range falls within $[0, T_{max}]$.

With reference to the first aspect and the foregoing implementation of the first aspect, in a fifth implementation of the first aspect, the determining a reference parameter according to a time-domain signal on the first sound channel and a time-domain signal on the second sound channel includes: performing cross-correlation processing on the time-domain signal on the first sound channel and the time-domain signal on the second sound channel, to determine a first cross-correlation processing value and a second cross-correlation processing value, where the first cross-correlation processing value is a maximum function value, within a preset range, of a cross-correlation function of the time-domain signal on the first sound channel relative to the time-domain signal on the second sound channel, and the second cross-correlation processing value is a maximum function value, within the preset range, of a cross-correlation function of the time-domain signal on the second sound channel relative to the time-domain signal on the first sound channel; and determining the reference parameter according to a value relationship between the first cross-correlation processing value and the second cross-correlation processing value.

With reference to the first aspect and the foregoing implementation of the first aspect, in a sixth implementation of the first aspect, the reference parameter is an index value corresponding to a larger one of the first cross-correlation processing value and the second cross-correlation processing value, or an opposite number of the index value.

With reference to the first aspect and the foregoing implementation of the first aspect, in a seventh implementation of the first aspect, the determining a reference parameter according to a time-domain signal on the first sound channel and a time-domain signal on the second sound channel includes: performing peak detection processing on the time-domain signal on the first sound channel and the time-domain signal on the second sound channel, to determine a first index value and a second index value, where the first index value is an index value corresponding to a maximum amplitude value of the time-domain signal on the first sound channel within a preset range, and the second index value is an index value corresponding to a maximum amplitude value of the time-domain signal on the second sound channel within the preset range; and determining the reference parameter according to a value relationship between the first index value and the second index value.

With reference to the first aspect and the foregoing implementations of the first aspect, in an eighth implementation of the first aspect, the method further includes: performing smoothing processing on the first ITD parameter based on a second ITD parameter, where the first ITD parameter is an ITD parameter in a first time period, the second ITD parameter is a smoothed value of an ITD parameter in a second time period, and the second time period is before the first time period.

According to a second aspect, an apparatus for determining an inter-channel time difference parameter is provided. The apparatus includes a determining unit configured to determine a target search complexity from a plurality of search complexities. The plurality of search complexities is in a one-to-one correspondence with a plurality of channel quality values. A processing unit is configured to perform search processing on a signal on a first sound channel and a signal on a second sound channel according to the target search complexity so as to determine a first ITD parameter corresponding to the first sound channel and the second sound channel.

With reference to the second aspect, in a first implementation of the second aspect, the determining unit is specifically configured to: obtain a coding parameter for a stereo signal, where the stereo signal is generated based on the signal on the first sound channel and the signal on the second sound channel, the coding parameter is determined according to a current channel quality value, and the coding parameter includes any one of the following parameters: a coding bit rate, a coding bit quantity, or a complexity control parameter used to indicate the search complexity; and determine the target search complexity from the plurality of search complexities according to the coding parameter.

With reference to the second aspect and the foregoing implementation of the second aspect, in a second implementation of the second aspect, the plurality of search complexities are in a one-to-one correspondence with a plurality of search steps, the plurality of search complexities include a first search complexity and a second search complexity, the plurality of search steps include a first search step and a second search step, the first search step corresponding to the first search complexity is less than the second search step corresponding to the second search complexity, and the first search complexity is higher than the second search complexity; and the processing unit is specifically configured to: determine a target search step corresponding to the target search complexity; and perform search processing on the signal on the first sound channel and the signal on the second sound channel according to the target search step.

With reference to the second aspect and the foregoing implementation of the second aspect, in a third implementation of the second aspect, the plurality of search complexities are in a one-to-one correspondence with a plurality of search ranges, the plurality of search complexities include a third search complexity and a fourth search complexity, the plurality of search ranges include a first search range and a second search range, the first search range corresponding to the third search complexity is greater than the second search range corresponding to the fourth search complexity, and the third search complexity is higher than the fourth search complexity; and the processing unit is specifically configured to: determine a target search range corresponding to the target search complexity; and perform search processing on the signal on the first sound channel and the signal on the second sound channel within the target search range.

With reference to the second aspect and the foregoing implementation of the second aspect, in a fourth implementation of the second aspect, the processing unit is specifically configured to: determine a reference parameter according to a time-domain signal on the first sound channel and a time-domain signal on the second sound channel, where the reference parameter is corresponding to a sequence of obtaining the time-domain signal on the first sound channel and the time-domain signal on the second sound channel, and the time-domain signal on the first sound channel and the time-domain signal on the second sound channel are corresponding to a same time period; and determine the target search range according to the target search complexity, the reference parameter, and a limiting value $T_{max}$, where the limiting value $T_{max}$ is determined according to a sampling rate of the time-domain signal on the first sound channel, and the target search range falls within $[-T_{max}, 0]$, or the target search range falls within $[0, T_{max}]$.

With reference to the second aspect and the foregoing implementation of the second aspect, in a fifth implementation of the second aspect, the processing unit is specifically configured to: perform cross-correlation processing on the time-domain signal on the first sound channel and the time-domain signal on the second sound channel, to determine a first cross-correlation processing value and a second cross-correlation processing value, where the first cross-correlation processing value is a maximum function value, within a preset range, of a cross-correlation function of the time-domain signal on the first sound channel relative to the time-domain signal on the second sound channel, and the second cross-correlation processing value is a maximum function value, within the preset range, of a cross-correlation function of the time-domain signal on the second sound channel relative to the time-domain signal on the first sound channel; and determine the reference parameter according to a value relationship between the first cross-correlation processing value and the second cross-correlation processing value.

With reference to the second aspect and the foregoing implementation of the second aspect, in a sixth implementation of the second aspect, the reference parameter is an index value corresponding to a larger one of the first cross-correlation processing value and the second cross-correlation processing value, or an opposite number of the index value.

With reference to the second aspect and the foregoing implementation of the second aspect, in a seventh implementation of the second aspect, the processing unit is specifically configured to: perform peak detection processing on the time-domain signal on the first sound channel and the time-domain signal on the second sound channel, to determine a first index value and a second index value, where the first index value is an index value corresponding to a maximum amplitude value of the time-domain signal on the first sound channel within a preset range, and the second index value is an index value corresponding to a maximum amplitude value of the time-domain signal on the second sound channel within the preset range; and determine the reference parameter according to a value relationship between the first index value and the second index value.

With reference to the second aspect and the foregoing implementations of the second aspect, in an eighth implementation of the second aspect, the processing unit is further configured to perform smoothing processing on the first ITD parameter based on a second ITD parameter, where the first ITD parameter is an ITD parameter in a first time period, the second ITD parameter is a smoothed value of an ITD parameter in a second time period, and the second time period is before the first time period.

According to the method and the apparatus for determining an inter-channel time difference parameter in the embodiments of the present disclosure, a target search complexity corresponding to current channel quality is determined from a plurality of search complexities, and search processing is performed on a signal on a first sound channel and a signal on a second sound channel according to the target search complexity, so that precision of a determined ITD parameter can adapt to the channel quality. Therefore, when the current channel quality is relatively poor, a complexity or a calculation amount of search processing can be reduced by using the target search complexity, so that computing resources can be reduced and processing efficiency can be improved.

BRIEF DESCRIPTION OF THE DRAWINGS

To describe the technical solutions in the embodiments of the present disclosure more clearly, the following briefly describes the accompanying drawings required for describing the embodiments of the present disclosure. Apparently, the accompanying drawings in the following description show merely some embodiments of the present disclosure, and a person of ordinary skill in the art may still derive other drawings from these accompanying drawings without creative efforts.

DETAILED DESCRIPTION OF ILLUSTRATIVE EMBODIMENTS

The following clearly describes the technical solutions in the embodiments of the present disclosure with reference to the accompanying drawings in the embodiments of the present disclosure. Apparently, the described embodiments are some but not all of the embodiments of the present disclosure. All other embodiments obtained by a person of ordinary skill in the art based on the embodiments of the present disclosure without creative efforts shall fall within the protection scope of the present disclosure.

Figure 1:
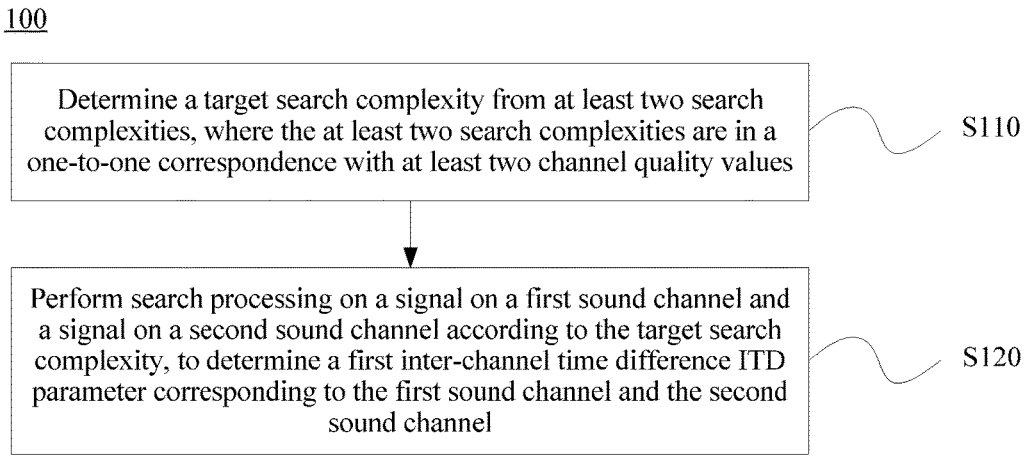
FIG. 1 is a schematic flowchart of a method for determining an inter-channel time difference parameter according to an embodiment of the present disclosure.

FIG. 1 is a schematic flowchart of a method 100 for determining an inter-channel time difference parameter according to an embodiment of the present disclosure. The method 100 may be performed by an encoder device (or may be referred to as a transmit end device) for transmitting an audio signal. As shown in FIG. 1, the method 100 includes the following steps:

S110. Determine a target search complexity from at least two search complexities, where the at least two search complexities are in a one-to-one correspondence with at least two channel quality values.

S120. Perform search processing on a signal on a first sound channel and a signal on a second sound channel according to the target search complexity, to determine a first inter-channel time difference ITD parameter corresponding to the first sound channel and the second sound channel.

The method 100 for determining an inter-channel time difference parameter in this embodiment of the present disclosure may be applied to an audio system that has at least two sound channels. In the audio system, mono signals from the at least two sound channels (that is, including a first sound channel and a second sound channel) are synthesized into a stereo signal. For example, a mono signal from an audio-left channel (that is, an example of the first sound channel) and a mono signal from an audio-right channel (that is, an example of the second sound channel) are synthesized into a stereo signal.

A parametric stereo (PS) technology may be used as an example of a method for transmitting the stereo signal. In the technology, an encoder converts the stereo signal into a mono signal and a spatial perception parameter according to a spatial perception feature, and separately encodes the mono signal and the spatial perception parameter. After obtaining mono audio, a decoder further restores the stereo signal according to the spatial perception parameter. In the technology, low-bit and high-quality transmission of the stereo signal can be implemented. An inter-channel time difference ITD parameter is a spatial perception parameter indicating a horizontal location of a sound source, and is an important part of the spatial perception parameter. This embodiment of the present disclosure is mainly related to a process of determining the ITD parameter. In addition, in this embodiment of the present disclosure, a process of encoding and decoding the stereo signal and the mono signal according to the ITD parameter is similar to that in the prior art. To avoid repetition, a detailed description thereof is omitted herein.

It should be understood that the foregoing quantity of sound channels included in the audio system is merely an example for description, and the present disclosure is not limited thereto. For example, the audio system may have three or more sound channels, and mono signals from any two sound channels can be synthesized into a stereo signal. For ease of understanding, in an example for description below, the method 100 is applied to an audio system that has two sound channels (that is, an audio-left channel and an audio-right channel). In addition, for ease of differentiation, the audio-left channel is used as the first sound channel, and the audio-right channel is used as the second sound channel for description.

In this embodiment of the present disclosure, for different search complexities, methods for obtaining an ITD parameter of the audio-left channel and the audio-right channel are different. Therefore, before determining an ITD parameter, the encoder device may first determine a current search complexity.

There is a mapping relationship between a search complexity and channel quality. That is, better channel quality indicates a higher coding bit rate and a larger coding bit quantity, and therefore, higher precision of an ITD parameter is required. On the contrary, poorer channel quality indicates a lower coding bit rate and a smaller coding bit quantity, and therefore, lower precision of an ITD parameter is required.

In this embodiment of the present disclosure, different search complexities are corresponding to different ITD parameter obtaining manners (subsequently, a specific relationship between a search complexity and an ITD parameter obtaining manner is described in detail). A higher search complexity indicates higher precision of an obtained ITD parameter. On the contrary, a lower search complexity indicates lower precision of an obtained ITD parameter.

Therefore, the encoder device selects a search complexity (that is, the target search complexity) corresponding to current channel quality, so that precision of the obtained ITD parameter can correspond to the current channel quality.

That is, in this embodiment of the present disclosure, multiple (that is, at least two) types of channel quality in a one-to-one correspondence with multiple (that is, at least two) search complexities are set, so that multiple (that is, at least two) communication conditions with different channel quality can be met, and further different precision requirements of an ITD parameter can be flexibly met.

In this embodiment of the present disclosure, the one-to-one correspondence between multiple (that is, at least two) types of channel quality and multiple (that is, at least two) search complexities may be directly recorded in a mapping entry (denoted as a mapping entry #1 for ease of understanding and differentiation), and is stored in the encoder device. Therefore, after obtaining the current channel quality, the encoder device may directly search the mapping entry #1 for a search complexity corresponding to the current channel quality as the target search complexity.

That is, there may be M levels of search complexities (or in other words, M search complexities are set, and are denoted as M, M−1, . . . , and 1), and the M levels of search complexities may be set to be in a one-to-one correspondence with M types of channel quality (for example, denoted as $Q_M$, $Q_{M-1}$, $Q_{M-2}$, . . . , and $Q_1$, where $Q_M > Q_{M-1} > Q_{M-2} > \ldots > Q_1$).

For example, a search complexity corresponding to channel quality $Q_M$ is M. If the current channel quality is higher than or equal to the channel quality $Q_M$, the determined target search complexity may be set to M.

For another example, a search complexity corresponding to channel quality $Q_{M-1}$ is M−1. If the current channel quality is higher than or equal to the channel quality $Q_{M-1}$, and is lower than the channel quality $Q_M$, the determined target search complexity may be set to M−1.

For another example, a search complexity corresponding to channel quality $Q_{M-2}$ is M−2. If the current channel quality is higher than or equal to the channel quality $Q_{M-2}$, and is lower than the channel quality $Q_{M-1}$, the determined target search complexity may be set to M−2.

For another example, a search complexity corresponding to channel quality $Q_2$ is 2. If the current channel quality is higher than or equal to the channel quality $Q_2$, and is lower than channel quality $Q_3$, the determined target search complexity may be set to 2.

For another example, a search complexity corresponding to channel quality $Q_1$ is 1. If the current channel quality is lower than the channel quality $Q_2$, the determined target search complexity may be set to 1.

It should be noted that channel quality is quality of a channel that is between the encoder and the decoder and that is used to transmit an audio signal, a subsequent ITD parameter, and the like.

It should be understood that the foregoing method for determining the target search complexity is merely an example for description, and the present disclosure is not limited thereto. For example, the following manner may be used.

Optionally, the determining a target search complexity from at least two search complexities includes obtaining a coding parameter, where the coding parameter is determined according to a current channel quality value, and the coding parameter includes any one of the following parameters: a coding bit rate, a coding bit quantity, or a complexity control parameter used to indicate the search complexity. The method further includes determining the target search complexity from the at least two search complexities according to the coding parameter.

Specifically, there is a correspondence between channel quality and both a coding bit rate and a coding bit quantity. That is, better channel quality indicates a higher coding bit rate and a larger coding bit quantity. On the contrary, poorer channel quality indicates a lower coding bit rate and a smaller coding bit quantity.

Therefore, in this embodiment of the present disclosure, a one-to-one correspondence between multiple (that is, at least two) coding bit rates and multiple (that is, at least two) search complexities may be recorded in a mapping entry (denoted as a mapping entry #2 for ease of understanding and differentiation), and is stored in the encoder device. Therefore, after obtaining a current coding bit rate, the encoder device may directly search the mapping entry #2 for a search complexity corresponding to the current coding bit rate as the target search complexity. Herein, a method and a process of obtaining the current coding bit rate by the encoder device may be similar to those in the prior art. To avoid repetition, a detailed description thereof is omitted.

That is, there may be M levels of search complexities (or in other words, M search complexities are set, and are denoted as M, M−1, . . . , and 1), and the M levels of search complexities may be set to be in a one-to-one correspondence with M coding bit rates (denoted as $B_M$, $B_{M-1}$, $B_{M-2}$, . . . , and $B_1$, where $B_M>B_{M-1}>B_{M-2}> \ldots >B_1$).

For example, a search complexity corresponding to a coding bit rate $B_M$ is M. If the current coding bit rate is higher than or equal to the coding bit rate $B_M$, the determined target search complexity may be set to M.

For another example, a search complexity corresponding to a coding bit rate $B_{M-1}$ is M−1. If the current coding bit rate is higher than or equal to the coding bit rate $B_{M-1}$, and is lower than the coding bit rate $B_M$, the determined target search complexity may be set to M−1.

For another example, a search complexity corresponding to a coding bit rate $B_{M-2}$ is M−2. If the current coding bit rate is higher than or equal to the coding bit rate $B_{M-2}$, and is lower than the coding bit rate $B_{M-1}$, the determined target search complexity may be set to M−2.

For another example, a search complexity corresponding to a coding bit rate $B_2$ is 2. If the current coding bit rate is higher than or equal to the coding bit rate $B_2$, and is lower than a coding bit rate $B_3$, the determined target search complexity may be set to 2.

For another example, a search complexity corresponding to a coding bit rate $B_1$ is 1. If the current coding bit rate is lower than the coding bit rate $B_2$, the determined target search complexity may be set to 1.

Alternatively, in this embodiment of the present disclosure, a one-to-one correspondence between multiple (that is, at least two) coding bit quantities and multiple (that is, at least two) search complexities may be recorded in a mapping entry (denoted as a mapping entry #3 for ease of understanding and differentiation), and is stored in the encoder device. Therefore, after obtaining a current coding bit quantity, the encoder device may directly search the mapping entry #3 for a search complexity corresponding to the current coding bit quantity as the target search complexity. Herein, a method and a process of obtaining the current coding bit quantity by the encoder device may be similar to those in the prior art. To avoid repetition, a detailed description thereof is omitted.

That is, there may be M levels of search complexities (or in other words, M search complexities are set, and are denoted as M, M−1, . . . , and 1), and the M levels of search complexities may be set to be in a one-to-one correspondence with M coding bit quantities (denoted as $C_M$, $C_{M-1}$, $C_{M-2}$, . . . , and $C_1$, where $C_M>C_{M-1}>C_{M-2}> \ldots >C_1$).

For example, a search complexity corresponding to a coding bit quantity $C_M$ is M. If the current coding bit quantity is higher than or equal to the coding bit quantity $C_M$, the determined target search complexity may be set to M.

For another example, a search complexity corresponding to a coding bit quantity $C_{M-1}$ is M−1. If the current coding bit quantity is higher than or equal to the coding bit quantity $C_{M-1}$, and is lower than a coding bit quantity $C_M$, the determined target search complexity may be set to M−1.

For another example, a search complexity corresponding to a coding bit quantity $C_{M-2}$ is M−2. If the current coding bit quantity is higher than or equal to the coding bit quantity $C_{M-2}$, and is lower than the coding bit quantity $C_{M-1}$, the determined target search complexity may be set to M−2.

For another example, a search complexity corresponding to a coding bit quantity $C_2$ is 2. If the current coding bit quantity is higher than or equal to the coding bit quantity $C_2$, and is lower than a coding bit quantity $C_3$, the determined target search complexity may be set to 2.

For another example, a search complexity corresponding to a coding bit quantity $C_1$ is 1. If the current coding bit quantity is lower than the coding bit quantity $C_2$, the determined target search complexity may be set to 1.

In addition, in this embodiment of the present disclosure, different complexity control parameters may be configured for different channel quality, so that different complexity control parameter values are corresponding to different search complexities, and further, a one-to-one correspondence between multiple (that is, at least two) complexity control parameter values and multiple (that is, at least two) search complexities can be recorded in a mapping entry (denoted as a mapping entry #4 for ease of understanding and differentiation), and be stored in the encoder device. Therefore, after obtaining a current complexity control parameter value, the encoder device may directly search the mapping entry #4 for a search complexity corresponding to the current complexity control parameter value as the target search complexity. Herein, a command line may be written in advance for the complexity control parameter value, so that the encoder device can read the current complexity control parameter value from the command line.

That is, there may be M levels of search complexities (or in other words, M search complexities are set, and are denoted as M, M−1, . . . , and 1), and the M levels of search complexities may be set to be in a one-to-one correspondence with M complexity control parameters (denoted as $N_M$, $N_{M-1}$, $N_{M-2}$, . . . , and $N_1$, where $N_M>N_{M-1}>N_{M-2}> \ldots >N_1$).

For example, a search complexity corresponding to a complexity control parameter $N_M$ is M. If the current complexity control parameter is greater than or equal to the complexity control parameter $N_M$, the determined target search complexity may be set to M.

For another example, a search complexity corresponding to a complexity control parameter $N_{M-1}$ is M−1. If the current complexity control parameter is greater than or equal to the complexity control parameter $N_{M-1}$, and is less than the complexity control parameter $N_M$, the determined target search complexity may be set to M−1.

For another example, a search complexity corresponding to a complexity control parameter $N_{M-2}$ is M−2. If the current complexity control parameter is greater than or equal to the complexity control parameter $N_{M-2}$, and is less than the complexity control parameter $N_{M-1}$, the determined target search complexity may be set to M−2.

For another example, a search complexity corresponding to a complexity control parameter $N_2$ is 2. If the current complexity control parameter is greater than or equal to the complexity control parameter $N_2$, and is less than a complexity control parameter $N_3$, the determined target search complexity may be set to 2.

For another example, a search complexity corresponding to a complexity control parameter $N_1$ is 1. If the current complexity control parameter is less than the complexity control parameter $N_2$, the determined target search complexity may be set to 1.

It should be understood that the foregoing coding bit rate, coding bit quantity, or complexity control parameter used as the coding parameter are merely examples for description, and the present disclosure is not limited thereto. Other information or parameters that can be determined according to channel quality or in other words, can reflect channel quality shall fall within the protection scope of the present disclosure.

After determining the target search complexity, in S120, the encoder device may perform search processing according to the target search complexity, to obtain the ITD parameter.

In this embodiment of the present disclosure, different search complexities may be corresponding to different search steps (that is, a case 1), or different search complexities may be corresponding to different search ranges (that is, a case 2). The following describes in detail processes of determining the ITD parameter by the encoder based on the target search complexity in the two cases.

Case 1:

The at least two search complexities are in a one-to-one correspondence with at least two search steps, the at least two search complexities include a first search complexity and a second search complexity, the at least two search steps include a first search step and a second search step, the first search step corresponding to the first search complexity is less than the second search step corresponding to the second search complexity, and the first search complexity is higher than the second search complexity.

The performing search processing on a signal on a first sound channel and a signal on a second sound channel according to the target search complexity includes: determining a target search step corresponding to the target search complexity; and performing search processing on the signal on the first sound channel and the signal on the second sound channel according to the target search step.

Specifically, in this embodiment of the present disclosure, the M search complexities (that is, M, M−1, . . . , and 1) may be in a one-to-one correspondence with M search steps (denoted as: $L_M$, $L_{M-1}$, $L_{M-2}$, . . . , and $L_1$, where $L_M<L_{M-1}<L_{M-2} \ldots <L_1$).

For example, a search complexity corresponding to a search step $L_M$ is M. If the determined target search complexity is M, the search step $L_M$ corresponding to the search complexity M may be set as the target search step.

For another example, a search complexity corresponding to a search step $L_{M-1}$ is M−1. If the determined target search complexity is M−1, the search step $L_{M-1}$ corresponding to the search complexity M−1 may be set as the target search step.

For another example, a search complexity corresponding to a search step $L_{M-2}$ is M−2. If the determined target search complexity is M−2, the search step $L_{M-2}$ corresponding to the search complexity M−2 may be set as the target search step.

For another example, a search complexity corresponding to a search step $L_2$ is 2. If the determined target search complexity is 2, the search step $L_2$ corresponding to the search complexity $L_2$ may be set as the target search step.

For another example, a search complexity corresponding to a search step $L_1$ is 1. If the determined target search complexity is 1, the search step $L_1$ corresponding to the search complexity 1 may be set as the target search step.

For example, in this embodiment of the present disclosure, specific values of the M search steps (that is, $L_M$, $L_{M-1}$, $L_{M-2}$, . . . , and $L_1$) may be determined according to the following formulas:

$$L_M = \left\lfloor \frac{2 * T_{max}}{M * K} \right\rfloor$$

$$L_{M-1} = \left\lfloor \frac{2 * T_{max}}{(M-1) * K} \right\rfloor$$

$$L_{M-i} = \left\lfloor \frac{2 * T_{max}}{(M-i) * K} \right\rfloor,$$

where $i \in [0, M-1]$

K is a preset value and indicates a quantity of search times corresponding to a lowest complexity, and $\lfloor\ \rfloor$ indicates a rounding down operation.

In addition, if $$\left\lfloor \frac{2 * T_{max}}{i * K} \right\rfloor * K < 2 * i * T_{max},$$

where $i \in [1, M]$, a quantity of search times corresponding to a search complexity i is increased by 1.

It should be noted that the foregoing method for determining each step and specific values are merely examples for description, and the present disclosure is not limited thereto. A method and a specific value may be randomly determined according to a requirement provided that $L_M<L_{M-1}<L_{M-2} \ldots <L_1$.

After the target search step (denoted as $L_t$ below for ease of understanding and differentiation) is determined, search processing may be performed on the signal on the audio-left channel and the signal on the audio-right channel according to the target search step, to determine the ITD parameter.

In addition, the foregoing search processing may be performed in a time domain (that is, in a manner 1), or may be performed in a frequency domain (that is, in a manner 2), and this is not particularly limited in the present disclosure. The following separately describes the two manners in detail.

Manner 1:

Specifically, the encoder device may obtain, for example, by using an audio input device such as a microphone corresponding to the audio-left channel, an audio signal corresponding to the audio-left channel, and perform sampling processing on the audio signal according to a preset sampling rate α (that is, an example of a sampling rate of a time-domain signal on the first sound channel), to generate a time-domain signal on the audio-left channel (that is, an example of the time-domain signal on the first sound channel, and denoted as a time-domain signal #L below for ease of understanding and differentiation). In addition, in this embodiment of the present disclosure, a process of obtaining the time-domain signal #L may be similar to that in the prior art. To avoid repetition, a detailed description thereof is omitted herein.

In this embodiment of the present disclosure, the sampling rate of the time-domain signal on the first sound channel is the same as a sampling rate of a time-domain signal on the second sound channel. Therefore, similarly, the encoder device may obtain, for example, by using an audio input device such as a microphone corresponding to the audio-right channel, an audio signal corresponding to the audio-right channel, and perform sampling processing on the audio signal according to the sampling rate $\alpha$, to generate a time-domain signal on the audio-right channel (that is, an example of the time-domain signal on the second sound channel, and denoted as a time-domain signal #R below for ease of understanding and differentiation).

It should be noted that in this embodiment of the present disclosure, the time-domain signal #L and the time-domain signal #R are time-domain signals corresponding to a same time period (or in other words, time-domain signals obtained in a same time period). For example, the time-domain signal #L and the time-domain signal #R may be time-domain signals corresponding to a same frame (that is, 20 ms). In this case, an ITD parameter corresponding to signals in the frame can be obtained based on the time-domain signal #L and the time-domain signal #R.

For another example, the time-domain signal #L and the time-domain signal #R may be time-domain signals corresponding to a same subframe (that is, 10 ms, 5 ms, or the like) in a same frame. In this case, multiple ITD parameters corresponding to signals in the frame can be obtained based on the time-domain signal #L and the time-domain signal #R. For example, if a subframe corresponding to the time-domain signal #L and the time-domain signal #R is 10 ms, two ITD parameters can be obtained by using signals in the frame (that is, 20 ms). For another example, if a subframe corresponding to the time-domain signal #L and the time-domain signal #R is 5 ms, four ITD parameters can be obtained by using signals in the frame (that is, 20 ms).

It should be understood that the foregoing lengths of the time period corresponding to the time-domain signal #L and the time-domain signal #R are merely examples for description, and the present disclosure is not limited thereto. A length of the time period may be randomly changed according to a requirement.

Then, the encoder may perform search processing on the time-domain signal #L and the time-domain signal #R according to the determined target search step (that is, $L_t$) by using the following steps.

Step 1: The encoder device may set i=0.

Step 2: The encoder device may determine, according to the following formula 1, a cross-correlation function $c_n(i)$ of the time-domain signal #L relative to the time-domain signal #R, and determine, according to the following formula 2, a cross-correlation function $c_p(i)$ of the time-domain signal #R relative to the time-domain signal #L, that is:

$$c_n(i) = \sum_{j=0}^{Length-1-i} x_R(j) \cdot x_L(j+i) \quad \text{formula 1}$$

$$c_p(i) = \sum_{j=0}^{Length-1-i} x_L(j) \cdot x_R(j+i) \quad \text{formula 2}$$

$x_R(j)$ indicates a signal value of the time-domain signal #R at a $j^{th}$ sampling point, $x_L(j+i)$ indicates a signal value of the time-domain signal #L at a $(j+i)^{th}$ sampling point, $x_L(j)$ indicates a signal value of the time-domain signal #L at the $j^{th}$ sampling point, $x_R(j+i)$ indicates a signal value of the time-domain signal #R at the $(j+i)^{th}$ sampling point, and Length indicates a total quantity of sampling points included in the time-domain signal #R and the time-domain signal #L, or in other words, a length of the time-domain signal #R and the time domain signal #L. For example, the length may be a length of a frame (that is, 20 ms), or may be a length of a subframe (for example, 10 ms, 5 ms, or the like).

Step 3: The encoder device may assume $i=i+L_t$, and repeatedly perform step 2 within a range $i \in [0, T_{max}]$.

$T_{max}$ indicates a limiting value of the ITD parameter (or in other words, a maximum value of an obtaining time difference between the time-domain signal #L and the time-domain signal #R), and may be determined according to the sampling rate $\alpha$. In addition, a method for determining $T_{max}$ may be similar to that in the prior art. To avoid repetition, a detailed description thereof is omitted herein.

Step 4: The encoder device may calculate a maximum value $$\max_{0 \le i \le T_{max}} (c_n(i))$$

that is of the cross-correlation function $c_n(i)$ of the time-domain signal #L relative to the time-domain signal #R and that is determined when search processing is performed on the time-domain signal #R and the time-domain signal #L by using the target search step (that is, $L_t$), and the encoder device may calculate a maximum value $$\max_{0 \le i \le T_{max}} (c_p(i))$$

that is of the cross-correlation function ($c_p(i)$) of the time-domain signal #R relative to the time-domain signal #L and that is determined when search processing is performed on the time-domain signal #R and the time-domain signal #L by using the target search step (that is, $L_t$).

The encoder device may compare $$\max_{0 \le i \le T_{max}} (c_n(i)) \text{ with } \max_{0 \le i \le T_{max}} (c_p(i)),$$

and determine the ITD parameter according to a comparison result.

For example, if $$\max_{0 \le i \le T_{max}} (c_n(i)) \le \max_{0 \le i \le T_{max}} (c_p(i)),$$

the encoder device may use an index value corresponding to $$\max_{0 \le i \le T_{max}} (c_p(i))$$

as the ITD parameter.

For another example, if $$\max_{0 \le i \le T_{max}} (c_n(i)) > \max_{0 \le i \le T_{max}} (c_p(i)),$$

the encoder device may use an opposite number of an index value corresponding to $$\max_{0 \le i \le T_{max}} (c_n(i))$$

as the ITD parameter.

$T_{max}$ indicates a limiting value of the ITD parameter (or in other words, a maximum value of an obtaining time difference between the time-domain signal #L and the time-domain signal #R), and may be determined according to the sampling rate α. In addition, a method for determining $T_{max}$ may be similar to that in the prior art. To avoid repetition, a detailed description thereof is omitted herein.

Manner 2:

The encoder device may perform time-to-frequency transformation processing on the time-domain signal #L to obtain a frequency-domain signal on the audio-left channel (that is, an example of a frequency-domain signal on the first sound channel, and denoted as a frequency-domain signal #L below for ease of understanding and differentiation), and may perform time-to-frequency transformation processing on the time-domain signal #R to obtain a frequency-domain signal on the audio-right channel (that is, an example of a frequency-domain signal on the second sound channel, and denoted as a frequency-domain signal #R below for ease of understanding and differentiation).

For example, in this embodiment of the present disclosure, the time-to-frequency transformation processing may be performed by using a fast Fourier transformation (FFT, Fast Fourier Transformation) technology based on the following formula 3:

$$X(k) = \sum_{n=0}^{Length} x(n) \cdot e^{-j\frac{2\pi \cdot n \cdot k}{FFT_LENGTH}},\ 0 \le k < \text{FFT_LENGTH} \qquad \text{formula 3}$$

X(k) indicates a frequency-domain signal, FFT_LENGTH indicates a time-to-frequency transformation length, x(n) indicates a time-domain signal (that is, the time-domain signal #L or the time-domain signal #R), and Length indicates a total quantity of sampling points included in the time-domain signal.

It should be understood that the foregoing process of the time-to-frequency transformation processing is merely an example for description, and the present disclosure is not limited thereto. A method and a process of the time-to-frequency transformation processing may be similar to those in the prior art. For example, a technology such as modified discrete cosine transform (MDCT) may be further used.

Then, the encoder device may perform search processing on the frequency-domain signal #L and the frequency-domain signal #R according to the determined target search step (that is, $L_t$) by using the following steps:

Step a: The encoder device may classify FFT_LENGTH frequencies of a frequency-domain signal into $N_{subband}$ subbands (for example, one subband) according to preset bandwidth A. A frequency included in a $k^{th}$ subband $A_k$ meets $A_{k-1} \le b \le A_k - 1$.

Step b: Set $j = -T_{max}$.

Step c: Calculate a correlation function mag(j) of the frequency-domain signal #L and the frequency-domain signal #R according to the following formula 4.

$$mag(j) = \sum_{b=A_{k-1}}^{A_k - 1} X_L(b) * X_R(b) * \exp\left(\frac{2\pi * b * j}{\text{FFT_LENFTH}}\right) \qquad \text{formula 4}$$

$X_L(b)$ indicates a signal value of the frequency-domain signal #L on a $b^{th}$ frequency, $X_R(b)$ indicates a signal value of the frequency-domain signal #R on the $b^{th}$ frequency, and FFT_LENGTH indicates a time-to-frequency transformation length.

Step d: The encoder device may assume $j = j + L_t$, and repeatedly perform step c within a range $j \in [-T_{max}, T_{max}]$.

$T_{max}$ indicates a limiting value of the ITD parameter (or in other words, a maximum value of an obtaining time difference between the time-domain signal #L and the time-domain signal #R), and may be determined according to the sampling rate α. In addition, a method for determining $T_{max}$ may be similar to that in the prior art. To avoid repetition, a detailed description thereof is omitted herein.

Therefore, the encoder device may determine that an ITD parameter value of the $k^{th}$ subband is $$T(k) = \arg \max_{-T_{max} \le j \le T_{max}} (mag(j)),$$

that is, an index value corresponding to a maximum value of mag(j).

Therefore, one or more (corresponding to the determined quantity of subbands) ITD parameter values of the audio-left channel and the audio-right channel may be obtained.

Then, the encoder device may further perform quantization processing and the like on the ITD parameter value, and send the processed ITD parameter value and a mono signal (for example, the time-domain signal #L, the time-domain signal #R, the frequency-domain signal #L, or the frequency-domain signal #R) to a decoder device (or in other words, a receive end device).

The decoder device may restore a stereo audio signal according to the mono audio signal and the ITD parameter value.

Case 2:

The at least two search complexities are in a one-to-one correspondence with at least two search ranges, the at least two search complexities include a third search complexity and a fourth search complexity, the at least two search ranges include a first search range and a second search range, the first search range corresponding to the third search complexity is greater than the second search range corresponding to the fourth search complexity, and the third search complexity is higher than the fourth search complexity.

The performing search processing on a signal on a first sound channel and a signal on a second sound channel according to the target search complexity includes: determining a target search range corresponding to the target search complexity; and performing search processing on the signal on the first sound channel and the signal on the second sound channel within the target search range.

Specifically, in this embodiment of the present disclosure, the M search complexities (that is, M, M−1, . . . , and 1) may be in a one-to-one correspondence with M search ranges (denoted as: $F_M$, $F_{M-1}$, $F_{M-2}$, . . . , and $F_1$, where $F_M > F_{M-1} > F_{M-2} > \ldots > F_1$).

For example, a search complexity corresponding to a search range $F_M$ is M. If the determined target search complexity is M, the search range $F_M$ corresponding to the search complexity M may be set as the target search range.

For another example, a search complexity corresponding to a search range $F_{M-1}$ is M−1. If the determined target search complexity is M−1, the search range $F_{M-1}$ corresponding to the search complexity M−1 may be set as the target search range.

For another example, a search complexity corresponding to a search range $F_{M-2}$ is M−2. If the determined target search complexity is M−2, the search range $F_{M-2}$ corresponding to the search complexity M−2 may be set as the target search range.

For another example, a search complexity corresponding to a search range $F_2$ is 2. If the determined target search complexity is 2, the search range $F_2$ corresponding to the search complexity 2 may be set as the target search range.

For another example, a search complexity corresponding to a search range $F_1$ is 1. If the determined target search complexity is 1, the search range $F_1$ corresponding to the search complexity 1 may be set as the target search range.

It should be noted that in this embodiment of the present disclosure, all the search ranges $F_M$, $F_{M-1}$, $F_{M-2}$, . . . , and $F_1$ may be search ranges in a time domain, or all the search ranges $F_M$, $F_{M-1}$, $F_{M-2}$, . . . , and $F_1$ may be search ranges in a frequency domain. This is not particularly limited in the present disclosure.

In this embodiment of the present disclosure, $[-T_{max}, T_{max}]$ may be determined as the search range $F_M$ corresponding to a highest search complexity in the frequency domain.

The following describes in detail a process of determining a search range corresponding to another search complexity in the frequency domain.

The determining a target search range corresponding to the target search complexity includes: determining a reference parameter according to a time-domain signal on the first sound channel and a time-domain signal on the second sound channel, where the reference parameter is corresponding to a sequence of obtaining the time-domain signal on the first sound channel and the time-domain signal on the second sound channel, and the time-domain signal on the first sound channel and the time-domain signal on the second sound channel are time-domain signals corresponding to a same time period; and determining the target search range according to the target search complexity, the reference parameter, and a limiting value $T_{max}$, where the limiting value $T_{max}$ is determined according to a sampling rate of the time-domain signal, and the target search range falls within $[-T_{max}, 0]$, or the target search range falls within $[0, T_{max}]$.

Specifically, the encoder device may determine the reference parameter according to the time-domain signal #L and the time-domain signal #R. The reference parameter may be corresponding to a sequence of obtaining the time-domain signal #L and the time-domain signal #R (for example, a sequence of inputting the time-domain signal #L and the time-domain signal #R into the audio input device). Subsequently, the correspondence is described in detail with reference to a process of determining the reference parameter.

In this embodiment of the present disclosure, the reference parameter may be determined by performing cross-correlation processing on the time-domain signal #L and the time-domain signal #R (that is, in a manner X), or the reference parameter may be determined by searching for maximum amplitude values of the time-domain signal #L and the time-domain signal #R (that is, in a manner Y). The following separately describes the manner X and the manner Y in detail.

Manner X:

Optionally, the determining a reference parameter according to a time-domain signal on the first sound channel and a time-domain signal on the second sound channel includes: performing cross-correlation processing on the time-domain signal on the first sound channel and the time-domain signal on the second sound channel, to determine a first cross-correlation processing value and a second cross-correlation processing value, where the first cross-correlation processing value is a maximum function value, within a preset range, of a cross-correlation function of the time-domain signal on the first sound channel relative to the time-domain signal on the second sound channel, and the second cross-correlation processing value is a maximum function value, within the preset range, of a cross-correlation function of the time-domain signal on the second sound channel relative to the time-domain signal on the first sound channel; and determining the reference parameter according to a value relationship between the first cross-correlation processing value and the second cross-correlation processing value.

Specifically, in this embodiment of the present disclosure, the encoder device may determine, according to the following formula 5, a cross-correlation function $c_n(i)$ of the time-domain signal #L relative to the time-domain signal #R, that is:

$$c_n(i) = \sum_{j=0}^{Length-1-i} x_R(j) \cdot x_L(j+i),\ i \in [0, T_{max}] \qquad \text{formula 5}$$

$T_{max}$ indicates a limiting value of the ITD parameter (or in other words, a maximum value of an obtaining time difference between the time-domain signal #L and the time-domain signal #R), and may be determined according to the sampling rate α. In addition, a method for determining $T_{max}$ may be similar to that in the prior art. To avoid repetition, a detailed description thereof is omitted herein. $x_R(j)$ indicates a signal value of the time-domain signal #R at a $j^{th}$ sampling point, $x_L(j+i)$ indicates a signal value of the time-domain signal #L at a $(j+i)^{th}$ sampling point, and Length indicates a total quantity of sampling points included in the time-domain signal #R, or in other words, a length of the time-domain signal #R. For example, the length may be a length of a frame (that is, 20 ms), or a length of a subframe (that is, 10 ms, 5 ms, or the like).

In addition, the encoder device may determine a maximum value $$\max_{0 \le i \le T_{max}} (c_n(i))$$

of the cross-correlation function $c_n(i)$.

Similarly, the encoder device may determine, according to the following formula 6, a cross-correlation function $c_p(i)$ of the time-domain signal #R relative to the time-domain signal #L, that is:

$$c_p(i) = \sum_{j=0}^{Length-1-i} x_L(j) \cdot x_R(j+i) \qquad \text{formula 6}$$

In addition, the encoder device may determine a maximum value $$\max_{0 \le i \le T_{max}} (c_p(i))$$

of the cross-correlation function $c_p(i)$.

In this embodiment of the present disclosure, the encoder device may determine a value of the reference parameter according to a relationship between $$\max_{0 \le i \le T_{max}} (c_n(i)) \text{ and } \max_{0 \le i \le T_{max}} (c_p(i))$$

in the following manner X1 or manner X2.

Manner X1

Figure 2:
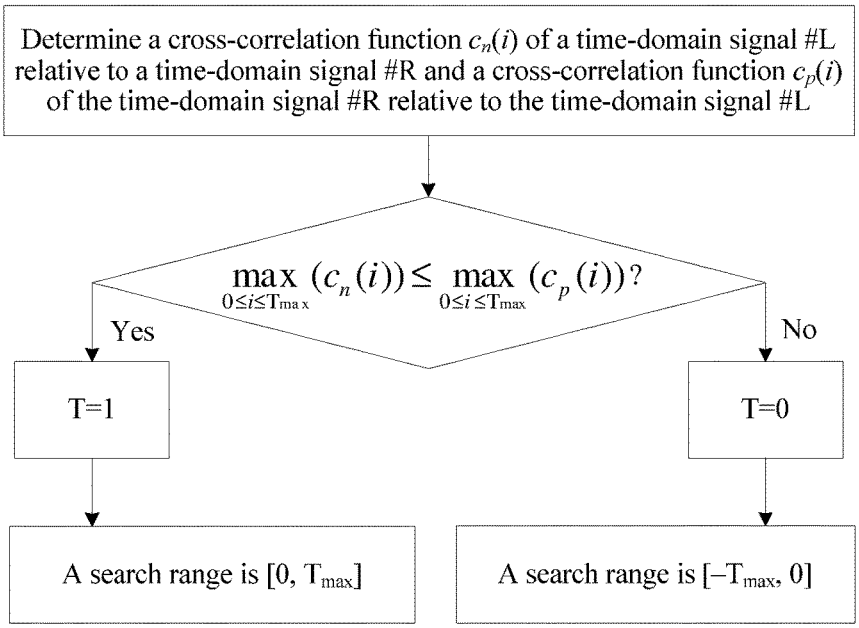
FIG. 2 is a schematic diagram of a process of determining a search range according to an embodiment of the present disclosure.

As shown in FIG. 2, if $$\max_{0 \le i \le T_{max}} (c_n(i)) \le \max_{0 \le i \le T_{max}} (c_p(i)),$$

the encoder device may determine that the time-domain signal #L is obtained before the time-domain signal #R, that is, the ITD parameter of the audio-left channel and the audio-right channel is a positive number. In this case, the reference parameter T may be set to 1.

Therefore, in a subsequent determining process, the encoder device may determine that the reference parameter is greater than 0, and further determine that the search range is $[0, T_{max}]$. That is, when the time-domain signal #L is obtained before the time-domain signal #R, the ITD parameter is a positive number, and the search range is $[0, T_{max}]$ (that is, an example of the search range that falls within $[0, T_{max}]$).

Alternatively, if $$\max_{0 \le i \le T_{max}} (c_n(i)) > \max_{0 \le i \le T_{max}} (c_p(i)),$$

the encoder device may determine that the time-domain signal #L is obtained after the time-domain signal #R, that is, the ITD parameter of the audio-left channel and the audio-right channel is a negative number. In this case, the reference parameter T may be set to 0.

Therefore, in a subsequent determining process, the encoder device may determine that the reference parameter is not greater than 0, and further determine that the search range is $[-T_{max}, 0]$. That is, when the time-domain signal #L is obtained after the time-domain signal #R, the ITD parameter is a negative number, and the search range is $[-T_{max}, 0]$ (that is, an example of the search range that falls within $[-T_{max}, 0]$).

Therefore, when two or more search complexities are included, a search range $F_2$, in the frequency domain, corresponding to a common search complexity (M=2) can be determined from $[-T_{max}, 0]$ and $[0, T_{max}]$.

Manner X2

Optionally, the reference parameter is an index value corresponding to a larger one of the first cross-correlation processing value and the second cross-correlation processing value, or an opposite number of the index value.

Figure 3:
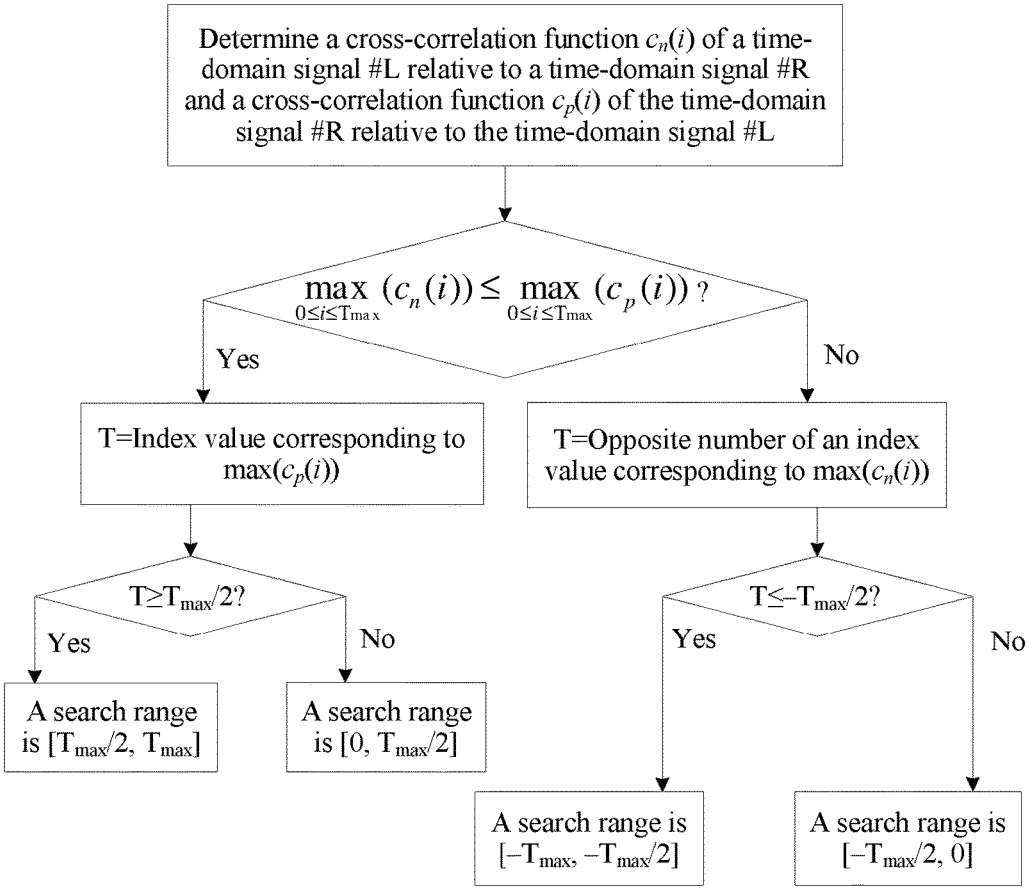
FIG. 3 is a schematic diagram of a process of determining a target search range according to another embodiment of the present disclosure.

Specifically, as shown in FIG. 3, if $$\max_{0 \le i \le T_{max}} (c_n(i)) \le \max_{0 \le i \le T_{max}} (c_p(i)),$$

the encoder device may determine that the time-domain signal #L is obtained before the time-domain signal #R, that is, the ITD parameter of the audio-left channel and the audio-right channel is a positive number. In this case, the reference parameter T may be set to an index value corresponding to $$\max_{0 \le i \le T_{max}} (c_p(i)).$$

Therefore, in a subsequent determining process, after determining that the reference parameter T is greater than 0, the encoder device may further determine whether the reference parameter T is greater than or equal to $T_{max}/2$, and determine the search range according to a determining result. For example, when $T \ge T_{max}/2$, the search range is $[T_{max}/2, T_{max}]$ (that is, an example of the search range that falls within $[0, T_{max}]$). When $T < T_{max}/2$, the search range is $[0, T_{max}/2]$ (that is, another example of the search range that falls within $[0, T_{max}]$).

Alternatively, if $$\max_{0 \le i \le T_{max}} (c_n(i)) > \max_{0 \le i \le T_{max}} (c_p(i)),$$

the encoder device may determine that the time-domain signal #L is obtained after the time-domain signal #R, that is, the ITD parameter of the audio-left channel and the audio-right channel is a negative number. In this case, the reference parameter T may be set to an opposite number of an index value corresponding to $$\max_{0 \le i \le T_{max}} (c_n(i)).$$

Therefore, in a subsequent determining process, after determining that the reference parameter T is less than or equal to 0, the encoder device may further determine whether the reference parameter T is less than or equal to $-T_{max}/2$, and determine the search range according to a determining result. For example, when $T \le -T_{max}/2$, the search range is $[-T_{max}, -T_{max}/2]$ (that is, an example of the search range that falls within $[-T_{max}, 0]$). When $T > -T_{max}/2$, the search range is $[-T_{max}/2, 0]$ (that is, another example of the search range that falls within $[-T_{max}, 0]$).

Therefore, when three or more search complexities are included, a search range $F_3$, in the frequency domain, corresponding to a lowest search complexity (M=1) can be determined from $[-T_{max}, -T_{max}/2]$, $[-T_{max}/2, 0]$, $[0, T_{max}/2]$, and $[T_{max}/2, T_{max}]$.

Manner Y

Optionally, the determining a reference parameter according to a time-domain signal on the first sound channel and a time-domain signal on the second sound channel includes: performing peak detection processing on the time-domain signal on the first sound channel and the time-domain signal on the second sound channel, to determine a first index value and a second index value, where the first index value is an index value corresponding to a maximum amplitude value of the time-domain signal on the first sound channel within a preset range, and the second index value is an index value corresponding to a maximum amplitude value of the time-domain signal on the second sound channel within the preset range; and determining the reference parameter according to a value relationship between the first index value and the second index value.

Specifically, in this embodiment of the present disclosure, the encoder device may detect a maximum value max(L(j)), $j \in [0, \text{Length}-1]$ of an amplitude value (denoted as L(j)) of the time-domain signal #L, and record an index value $p_{left}$ corresponding to max(L(j)). Length indicates a total quantity of sampling points included in the time-domain signal #L.

In addition, the encoder device may detect a maximum value max(R(j)), $j \in [0, \text{Length}-1]$ of an amplitude value (denoted as R(j)) of the time-domain signal #R, and record an index value $p_{right}$ corresponding to max(R(j)). Length indicates a total quantity of sampling points included in the time-domain signal #R.

Then, the encoder device may determine a value relationship between $p_{left}$ and $p_{right}$.

Figure 4:
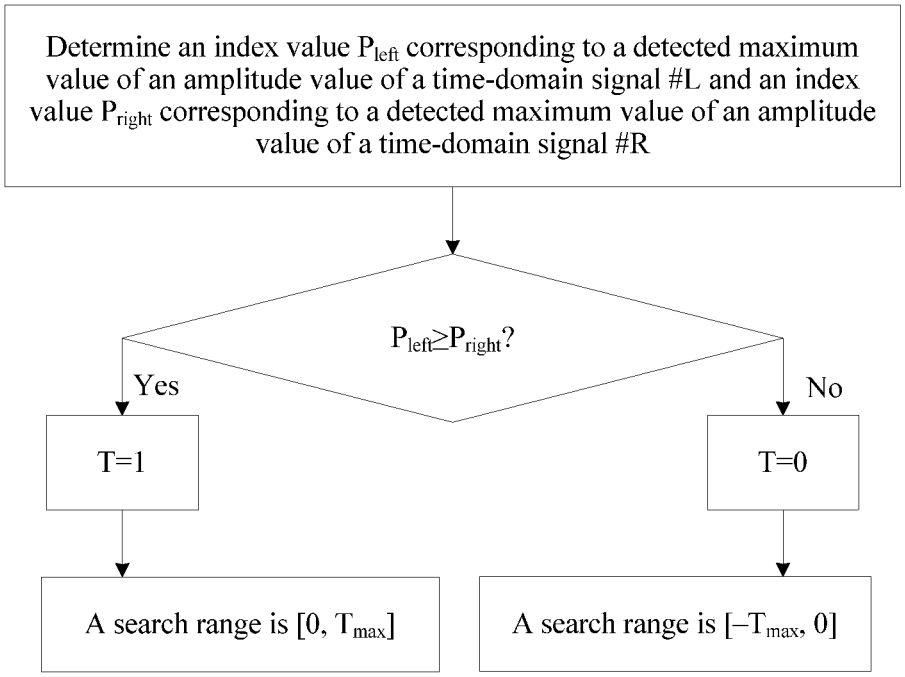
FIG. 4 is a schematic diagram of a process of determining a target search range according to still another embodiment of the present disclosure.

As shown in FIG. 4, if $p_{left} \geq p_{right}$, the encoder device may determine that the time-domain signal #L is obtained before the time-domain signal #R, that is, the ITD parameter of the audio-left channel and the audio-right channel is a positive number. In this case, the reference parameter T may be set to 1.

Therefore, in a subsequent determining process, the encoder device may determine that the reference parameter is greater than 0, and further determine that the search range is $[0, T_{max}]$. That is, when the time-domain signal #L is obtained before the time-domain signal #R, the ITD parameter is a positive number, and the search range is $[0, T_{max}]$ (that is, an example of the search range that falls within $[0, T_{max}]$).

Alternatively, if $p_{left} < p_{right}$, the encoder device may determine that the time-domain signal #L is obtained after the time-domain signal #R, that is, the ITD parameter of the audio-left channel and the audio-right channel is a negative number. In this case, the reference parameter T may be set to 0.

Therefore, in a subsequent determining process, the encoder device may determine that the reference parameter is not greater than 0, and further determine that the search range is $[-T_{max}, 0]$. That is, when the time-domain signal #L is obtained after the time-domain signal #R, the ITD parameter is a negative number, and the search range is $[-T_{max}, 0]$ (that is, an example of the search range that falls within $[-T_{max}, 0]$).

Therefore, when two or more search complexities are included, a search range $F_2$, in the frequency domain, corresponding to a common search complexity (M=2) can be determined from $[-T_{max}, 0]$ and $[0, T_{max}]$.

It should be understood that the foregoing methods for determining the search range and specific values of the search range are merely examples for description, and the present disclosure is not limited thereto. A method and a specific value may be randomly determined according to a requirement provided that $F_M > F_{M-1} > F_{M-2} > \ldots > F_1$.

The encoder device may perform time-to-frequency transformation processing on the time-domain signal #L to obtain a frequency-domain signal on the audio-left channel (that is, an example of a frequency-domain signal on the first sound channel, and denoted as a frequency-domain signal #L below for ease of understanding and differentiation), and may perform time-to-frequency transformation processing on the time-domain signal #R to obtain a frequency-domain signal on the audio-right channel (that is, an example of a frequency-domain signal on the second sound channel, and denoted as a frequency-domain signal #R below for ease of understanding and differentiation).

For example, in this embodiment of the present disclosure, the time-to-frequency transformation processing may be performed by using a fast Fourier transformation (FFT) technology based on the following formula 7:

$$X(k) = \sum_{n=0}^{Length} x(n) \cdot e^{-j\frac{2\pi \cdot n \cdot k}{FFT_LENGTH}}, \quad 0 \leq k < \text{FFT_LENGTH} \qquad \text{formula 7}$$

X(k) indicates a frequency-domain signal, FFT_LENGTH indicates a time-to-frequency transformation length, x(n) indicates a time-domain signal (that is, the time-domain signal #L or the time-domain signal #R), and Length indicates a total quantity of sampling points included in the time-domain signal.

It should be understood that the foregoing process of the time-to-frequency transformation processing is merely an example for description, and the present disclosure is not limited thereto. A method and a process of the time-to-frequency transformation processing may be similar to those in the prior art. For example, a technology such as modified discrete cosine transform may be further used.

Therefore, the encoder device may perform search processing on the determined frequency-domain signal #L and frequency-domain signal #R within the determined search range, to determine the ITD parameter of the audio-left channel and the audio-right channel. For example, the following search processing process may be used.

First, the encoder device may classify FFT_LENGTH frequencies of a frequency-domain signal into $N_{subband}$ subbands (for example, one subband) according to preset bandwidth A. A frequency included in a $k^{th}$ subband $A_k$ meets $A_{k-1} \leq b \leq A_k - 1$.

Within the foregoing search range, a correlation function mag(j) of the frequency-domain signal #L is calculated according to the following formula 8:

$$mag(j) = \sum_{b=A_{k-1}}^{A_k-1} X_L(b) * X_R(b) * \exp\left(\frac{2\pi * b * j}{\text{FFT_LENFTH}}\right) \qquad \text{formula 8}$$

$X_L(b)$ indicates a signal value of the frequency-domain signal #L on a $b^{th}$ frequency, $X_R(b)$ indicates a signal value of the frequency-domain signal #R on the $b^{th}$ frequency, FFT_LENGTH indicates a time-to-frequency transformation length, and a value range of j is the determined search range. For ease of understanding and description, the search range is denoted as [a, b].

An ITD parameter value of the $k^{th}$ subband is $$T(k) = \arg\max_{a \leq j \leq b} (mag(j)),$$

that is, an index value corresponding to a maximum value of mag(j).

Therefore, one or more (corresponding to the determined quantity of subbands) ITD parameter values of the audio-left channel and the audio-right channel may be obtained.

Then, the encoder device may further perform quantization processing and the like on the ITD parameter value, and send the processed ITD parameter value and a mono signal obtained after processing such as downmixing is performed on signals on the audio-left channel and the audio-right channel to a decoder device (or in other words, a receive end device).

The decoder device may restore a stereo audio signal according to the mono audio signal and the ITD parameter value.

Optionally, the method further includes: performing smoothing processing on the first ITD parameter based on a second ITD parameter, where the first ITD parameter is an ITD parameter in a first time period, the second ITD parameter is a smoothed value of an ITD parameter in a second time period, and the second time period is before the first time period.

Specifically, in this embodiment of the present disclosure, before performing quantization processing on the ITD parameter value, the encoder device may further perform smoothing processing on the determined ITD parameter value. As an example rather than a limitation, the encoder device may perform the smoothing processing according to the following formula 5:

$$T_{sm}(k)=w_1*T_{sm}^{[-1]}(k)+w_2*T(k) \quad \text{formula 5}$$

$T_{sm}(k)$ indicates an ITD parameter value on which smoothing processing has been performed and that is corresponding to a $k^{th}$ frame or a $k^{th}$ subframe, $T_{sm}^{[-1]}$ indicates an ITD parameter value on which smoothing processing has been performed and that is corresponding to a $(k-1)^{th}$ frame or a $(k-1)^{th}$ subframe, T(k) indicates an ITD parameter value on which smoothing processing has not been performed and that is corresponding to the $k^{th}$ frame or the $k^{th}$ subframe, $w_1$ and $w_2$ are smoothing factors, and $w_1$ and $w_2$ may be set to constants, or $w_1$ and $w_2$ may be set according to a difference between $T_{sm}^{[-1]}$ and T(k) provided that $w_1+w_2=1$ is met. In addition, when k=1, $T_{sm}^{[-1]}$ may be a preset value.

It should be noted that in the method for determining an inter-channel time difference parameter in this embodiment of the present disclosure, the smoothing processing may be performed by the encoder device, or may be performed by the decoder device, and this is not particularly limited in the present disclosure. That is, the encoder device may directly send the obtained ITD parameter value to the decoder device without performing smoothing processing, and the decoder device performs smoothing processing on the ITD parameter value. In addition, a method and a process of performing smoothing processing by the decoder device may be similar to the foregoing method and process of performing smoothing processing by the encoder device. To avoid repetition, a detailed description thereof is omitted herein.

According to the method for determining an inter-channel time difference parameter in this embodiment of the present disclosure, a target search complexity corresponding to current channel quality is determined from at least two search complexities, and search processing is performed on a signal on a first sound channel and a signal on a second sound channel according to the target search complexity, so that precision of a determined ITD parameter can adapt to the channel quality. Therefore, when the current channel quality is relatively poor, a complexity or a calculation amount of search processing can be reduced by using the target search complexity, so that computing resources can be reduced and processing efficiency can be improved.

The method for determining an inter-channel time difference parameter in the embodiments of the present disclosure is described above in detail with reference to FIG. 1 to FIG. 4. An apparatus for determining an inter-channel time difference parameter according to an embodiment of the present disclosure is described below in detail with reference to FIG. 5.

Figure 5:
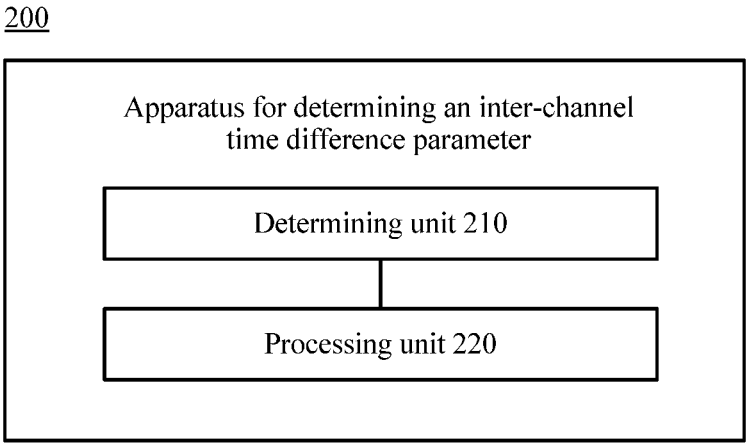
FIG. 5 is a schematic block diagram of an apparatus for determining an inter-channel time difference parameter according to an embodiment of the present disclosure.

FIG. 5 is a schematic block diagram of an apparatus 200 for determining an inter-channel time difference parameter according to an embodiment of the present disclosure. As shown in FIG. 5, the apparatus 200 includes: a determining unit 210, configured to determine a target search complexity from at least two search complexities, where the at least two search complexities are in a one-to-one correspondence with at least two channel quality values; and a processing unit 220, configured to perform search processing on a signal on a first sound channel and a signal on a second sound channel according to the target search complexity, to determine a first inter-channel time difference ITD parameter corresponding to the first sound channel and the second sound channel.

Optionally, the determining unit 210 is specifically configured to: obtain a coding parameter for a stereo signal, where the stereo signal is generated based on the signal on the first sound channel and the signal on the second sound channel, the coding parameter is determined according to a current channel quality value, and the coding parameter includes any one of the following parameters: a coding bit rate, a coding bit quantity, or a complexity control parameter used to indicate the search complexity; and determine the target search complexity from the at least two search complexities according to the coding parameter.

Optionally, the at least two search complexities are in a one-to-one correspondence with at least two search steps, the at least two search complexities include a first search complexity and a second search complexity, the at least two search steps include a first search step and a second search step, the first search step corresponding to the first search complexity is less than the second search step corresponding to the second search complexity, and the first search complexity is higher than the second search complexity. The processing unit 220 is specifically configured to: determine a target search step corresponding to the target search complexity; and perform search processing on the signal on the first sound channel and the signal on the second sound channel according to the target search step.

Optionally, the at least two search complexities are in a one-to-one correspondence with at least two search ranges, the at least two search complexities comprise a third search complexity and a fourth search complexity, the at least two search ranges comprise a first search range and a second search range, the first search range corresponding to the third search complexity is greater than the second search range corresponding to the fourth search complexity, and the third search complexity is higher than the fourth search complexity. The processing unit 220 is specifically configured to: determine a target search range corresponding to the target search complexity; and perform search processing on the signal on the first sound channel and the signal on the second sound channel within the target search range.

Optionally, the processing unit 220 is specifically configured to determine: a reference parameter according to a time-domain signal on the first sound channel and a time-domain signal on the second sound channel, where the reference parameter is corresponding to a sequence of obtaining the time-domain signal on the first sound channel and the time-domain signal on the second sound channel, and the time-domain signal on the first sound channel and the time-domain signal on the second sound channel are corresponding to a same time period; and determine the target search range according to the target search complexity, the reference parameter, and a limiting value $T_{max}$, where the limiting value $T_{max}$ is determined according to a sampling rate of the time-domain signal on the first sound channel, and the target search range falls within $[-T_{max}, 0]$, or the target search range falls within $[0, T_{max}]$.

Optionally, the processing unit 220 is specifically configured to: perform cross-correlation processing on the time-domain signal on the first sound channel and the time-domain signal on the second sound channel, to determine a first cross-correlation processing value and a second cross-correlation processing value, where the first cross-correlation processing value is a maximum function value, within a preset range, of a cross-correlation function of the time-domain signal on the first sound channel relative to the time-domain signal on the second sound channel, and the second cross-correlation processing value is a maximum function value, within the preset range, of a cross-correlation function of the time-domain signal on the second sound channel relative to the time-domain signal on the first sound channel; and determine the reference parameter according to a value relationship between the first cross-correlation processing value and the second cross-correlation processing value.

Optionally, the reference parameter is an index value corresponding to a larger one of the first cross-correlation processing value and the second cross-correlation processing value, or an opposite number of the index value.

Optionally, the processing unit 220 is specifically configured to: perform peak detection processing on the time-domain signal on the first sound channel and the time-domain signal on the second sound channel, to determine a first index value and a second index value, where the first index value is an index value corresponding to a maximum amplitude value of the time-domain signal on the first sound channel within a preset range, and the second index value is an index value corresponding to a maximum amplitude value of the time-domain signal on the second sound channel within the preset range; and determine the reference parameter according to a value relationship between the first index value and the second index value.

Optionally, the processing unit 220 is further configured to perform smoothing processing on the first ITD parameter based on a second ITD parameter. The first ITD parameter is an ITD parameter in a first time period, the second ITD parameter is a smoothed value of an ITD parameter in a second time period, and the second time period is before the first time period.

The apparatus 200 for determining an inter-channel time difference parameter according to this embodiment of the present disclosure is configured to perform the method 100 for determining an inter-channel time difference parameter in the embodiments of the present disclosure, and may be corresponding to the encoder device in the method in the embodiments of the present disclosure. In addition, units and modules in the apparatus 200 for determining an inter-channel time difference parameter and the foregoing other operations and/or functions are separately intended to implement a corresponding procedure in the method 100 in FIG. 1. For brevity, details are not described herein.

According to the apparatus for determining an inter-channel time difference parameter in this embodiment of the present disclosure, a target search complexity corresponding to current channel quality is determined from at least two search complexities, and search processing is performed on a signal on a first sound channel and a signal on a second sound channel according to the target search complexity, so that precision of a determined ITD parameter can adapt to the channel quality. Therefore, when the current channel quality is relatively poor, a complexity or a calculation amount of search processing can be reduced by using the target search complexity, so that computing resources can be reduced and processing efficiency can be improved.

The method for determining an inter-channel time difference parameter in the embodiments of the present disclosure is described above in detail with reference to FIG. 1 to FIG. 4. A device for determining an inter-channel time difference parameter according to an embodiment of the present disclosure is described below in detail with reference to FIG. 6.

Figure 6:
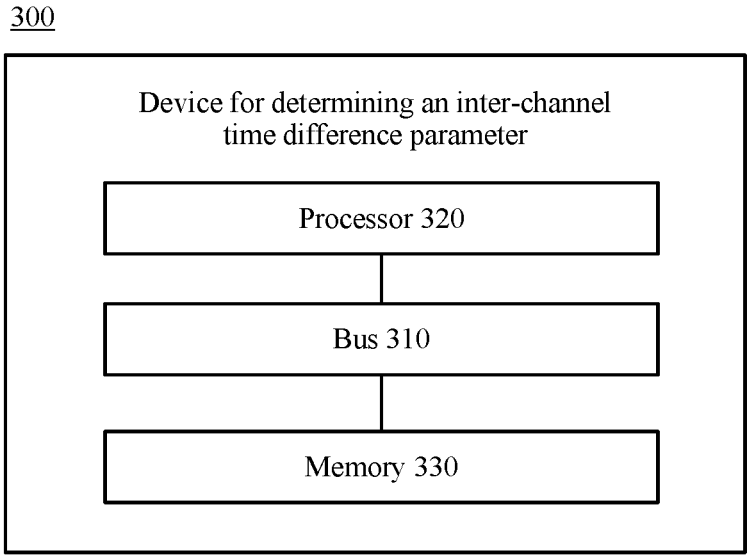
FIG. 6 is a schematic structural diagram of a device for determining an inter-channel time difference parameter according to an embodiment of the present disclosure.

FIG. 6 is a schematic block diagram of a device 300 for determining an inter-channel time difference parameter according to an embodiment of the present disclosure. As shown in FIG. 6, the device 300 may include: a bus 310; a processor 320 connected to the bus; and a memory 330 connected to the bus.

The processor 320 invokes, by using the bus 310, a program stored in the memory 330, so as to: determine a target search complexity from at least two search complexities, where the at least two search complexities are in a one-to-one correspondence with at least two channel quality values; and perform search processing on a signal on a first sound channel and a signal on a second sound channel according to the target search complexity, to determine a first inter-channel time difference ITD parameter corresponding to the first sound channel and the second sound channel.

Optionally, the processor 320 is specifically configured to: obtain a coding parameter for a stereo signal, where the stereo signal is generated based on the signal on the first sound channel and the signal on the second sound channel, the coding parameter is determined according to a current channel quality value, and the coding parameter includes any one of the following parameters: a coding bit rate, a coding bit quantity, or a complexity control parameter used to indicate the search complexity; and determine the target search complexity from the at least two search complexities according to the coding parameter.

Optionally, the at least two search complexities are in a one-to-one correspondence with at least two search steps, the at least two search complexities include a first search complexity and a second search complexity, the at least two search steps include a first search step and a second search step, the first search step corresponding to the first search complexity is less than the second search step corresponding to the second search complexity, and the first search complexity is higher than the second search complexity; and the processor 320 is specifically configured to: determine a target search step corresponding to the target search complexity; and perform search processing on the signal on the first sound channel and the signal on the second sound channel according to the target search step.

Optionally, the at least two search complexities are in a one-to-one correspondence with at least two search ranges, the at least two search complexities include a third search complexity and a fourth search complexity, the at least two search ranges include a first search range and a second search range, the first search range corresponding to the third search complexity is greater than the second search range corresponding to the fourth search complexity, and the third search complexity is higher than the fourth search complexity; and the processor 320 is specifically configured to: determine a target search range corresponding to the target search complexity; and perform search processing on the signal on the first sound channel and the signal on the second sound channel within the target search range.

Optionally, the processor 320 is specifically configured to: determine a reference parameter according to a time-domain signal on the first sound channel and a time-domain signal on the second sound channel, where the reference parameter is corresponding to a sequence of obtaining the time-domain signal on the first sound channel and the time-domain signal on the second sound channel, and the time-domain signal on the first sound channel and the time-domain signal on the second sound channel are corresponding to a same time period; and determine the target search range according to the target search complexity, the reference parameter, and a limiting value $T_{max}$, where the limiting value $T_{max}$ is determined according to a sampling rate of the time-domain signal on the first sound channel, and the target search range falls within $[-T_{max}, 0]$, or the target search range falls within $[0, T_{max}]$.

Optionally, the processor 320 is specifically configured to: perform cross-correlation processing on the time-domain signal on the first sound channel and the time-domain signal on the second sound channel, to determine a first cross-correlation processing value and a second cross-correlation processing value, where the first cross-correlation processing value is a maximum function value, within a preset range, of a cross-correlation function of the time-domain signal on the first sound channel relative to the time-domain signal on the second sound channel, and the second cross-correlation processing value is a maximum function value, within the preset range, of a cross-correlation function of the time-domain signal on the second sound channel relative to the time-domain signal on the first sound channel; and determine the reference parameter according to a value relationship between the first cross-correlation processing value and the second cross-correlation processing value.

Optionally, the reference parameter is an index value corresponding to a larger one of the first cross-correlation processing value and the second cross-correlation processing value, or an opposite number of the index value.

Optionally, the processor 320 is specifically configured to: perform peak detection processing on the time-domain signal on the first sound channel and the time-domain signal on the second sound channel, to determine a first index value and a second index value, where the first index value is an index value corresponding to a maximum amplitude value of the time-domain signal on the first sound channel within a preset range, and the second index value is an index value corresponding to a maximum amplitude value of the time-domain signal on the second sound channel within the preset range; and determine the reference parameter according to a value relationship between the first index value and the second index value.

Optionally, the processor 320 is further configured to perform smoothing processing on the first ITD parameter based on a second ITD parameter. The first ITD parameter is an ITD parameter in a first time period, the second ITD parameter is a smoothed value of an ITD parameter in a second time period, and the second time period is before the first time period.

In this embodiment of the present disclosure, components of the device 300 are coupled together by using the bus 310. In addition to a data bus, the bus 310 further includes a power supply bus, a control bus, and a status signal bus. However, for clarity of description, various buses are marked as the bus 310 in the figure.

The processor 320 may implement or perform the steps and the logical block diagrams disclosed in the method embodiments of the present disclosure. The processor 320 may be a microprocessor, or the processor may be any conventional processor or decoder, or the like. The steps of the methods disclosed with reference to the embodiments of the present disclosure may be directly performed and completed by means of a hardware processor, or may be performed and completed by using a combination of hardware and software modules in a decoding processor. The software module may be located in a mature storage medium in the field, such as a random access memory, a flash memory, a read-only memory, a programmable read-only memory, an electrically-erasable programmable memory, or a register. The storage medium is located in the memory 330, and the processor reads information in the memory 330 and completes the steps in the foregoing methods in combination with hardware of the processor.

It should be understood that in this embodiment of the present disclosure, the processor 320 may be a central processing unit (CPU), or the processor 320 may be another general-purpose processor, a digital signal processor (DSP), an application-specific integrated circuit (ASIC), a field programmable gate array (FPGA) or another programmable logical device, a discrete gate or a transistor logical device, a discrete hardware component, or the like. The general-purpose processor may be a microprocessor, or the processor may be any conventional processor, or the like.

The memory 330 may include a read-only memory and a random access memory, and provide an instruction and data for the processor 320. A part of the memory 330 may further include a nonvolatile random access memory. For example, the memory 330 may further store information about a device type.

In an implementation process, the steps in the foregoing methods may be completed by an integrated logic circuit of hardware in the processor 320 or an instruction in a form of software. The steps of the methods disclosed with reference to the embodiments of the present disclosure may be directly performed and completed by means of a hardware processor, or may be performed and completed by using a combination of hardware and software modules in the processor. The software module may be located in a mature storage medium in the field, such as a random access memory, a flash memory, a read-only memory, a programmable read-only memory, an electrically-erasable programmable memory, or a register.

The device 300 for determining an inter-channel time difference parameter according to this embodiment of the present disclosure is configured to perform the method 100 for determining an inter-channel time difference parameter in the embodiments of the present disclosure, and may be corresponding to the encoder device in the method in the embodiments of the present disclosure. In addition, units and modules in the device 300 for determining an inter-channel time difference parameter and the foregoing other operations and/or functions are separately intended to implement a corresponding procedure in the method 100 in FIG. 1. For brevity, details are not described herein.

According to the device for determining an inter-channel time difference parameter in this embodiment of the present disclosure, a target search complexity corresponding to current channel quality is determined from at least two search complexities, and search processing is performed on a signal on a first sound channel and a signal on a second sound channel according to the target search complexity, so that precision of a determined ITD parameter can adapt to the channel quality. Therefore, when the current channel quality is relatively poor, a complexity or a calculation amount of search processing can be reduced by using the target search complexity, so that computing resources can be reduced and processing efficiency can be improved.

It should be understood that sequence numbers of the foregoing processes do not mean execution sequences in the embodiments of the present disclosure. The execution sequences of the processes should be determined according to functions and internal logic of the processes, and should not be construed as any limitation on the implementation processes of the embodiments of the present disclosure.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present disclosure.

It may be clearly understood by a person skilled in the art that, for the purpose of convenient and brief description, for a detailed working process of the foregoing system, apparatus, and unit, refer to a corresponding process in the foregoing method embodiments, and details are not described herein again.

In the several embodiments provided in this application, it should be understood that the disclosed system, apparatus, and method may be implemented in other manners. For example, the described apparatus embodiment is merely an example. For example, the unit division is merely logical function division and may be other division during actual implementation. For example, multiple units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on multiple network units. Some or all of the units may be selected according to actual requirements to achieve the objectives of the solutions of the embodiments.

In addition, functional units in the embodiments of the present disclosure may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of the present disclosure essentially, or the part contributing to the prior art, or some of the technical solutions may be implemented in a form of a software product. The software product is stored in a storage medium, and includes several instructions for instructing a computer device (which may be a personal computer, a server, or a network device) to perform all or some of the steps of the methods described in the embodiments of the present disclosure. The foregoing storage medium includes: any medium that can store program code, such as a USB flash drive, a removable hard disk, a read-only memory (ROM), a random access memory (RAM), a magnetic disk, or an optical disc.

The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A method for determining an inter-channel time difference parameter, the method comprising:

determining a target search complexity from a plurality of search complexities by directly searching a mapping entry for a channel quality value of a plurality of channel quality values, wherein the mapping entry is a mapping relationship between the plurality of search complexities and a plurality of channel quality values, and wherein the plurality of search complexities are in a one-to-one correspondence with the plurality of channel quality values; and performing search processing on a signal on a first sound channel and a signal on a second sound channel according to the target search complexity so as to determine a first inter-channel time difference (ITD) parameter corresponding to the first sound channel and the second sound channel.

2. The method according to claim 1, wherein the determining a target search complexity comprises:

obtaining a coding parameter for a stereo signal, wherein the stereo signal is generated based on the signal on the first sound channel and the signal on the second sound channel, the coding parameter is determined according to a current channel quality value, and the coding parameter comprises any one of the following parameters: a coding bit rate, a coding bit quantity, or a complexity control parameter used to indicate a search complexity; and determining the target search complexity from the plurality of search complexities according to the coding parameter.

3. The method according to claim 1, wherein the plurality of search complexities are in a one-to-one correspondence with a plurality of search steps, the plurality of search complexities comprise a first search complexity and a second search complexity, the plurality of search steps comprise a first search step and a second search step, the first search step corresponding to the first search complexity is less than the second search step corresponding to the second search complexity, and the first search complexity is higher than the second search complexity; and the performing search processing on a signal on a first sound channel and a signal on a second sound channel according to the target search complexity comprises:

determining a target search step corresponding to the target search complexity; and performing search processing on the signal on the first sound channel and the signal on the second sound channel according to the target search step.

4. The method according to claim 1, wherein the plurality of search complexities are in a one-to-one correspondence with a plurality of search ranges, the plurality of search complexities comprise a third search complexity and a fourth search complexity, the plurality of search ranges comprise a first search range and a second search range, the first search range corresponding to the third search complexity is greater than the second search range corresponding to the fourth search complexity, and the third search complexity is higher than the fourth search complexity; and the performing search processing on a signal on a first sound channel and a signal on a second sound channel according to the target search complexity comprises:

determining a target search range corresponding to the target search complexity; and performing search processing on the signal on the first sound channel and the signal on the second sound channel within the target search range.

5. The method according to claim 4, wherein the determining a target search range corresponding to the target search complexity comprises:

determining a reference parameter according to a time-domain signal on the first sound channel and a time-domain signal on the second sound channel, wherein the reference parameter is corresponding to a sequence of obtaining the time-domain signal on the first sound channel and the time-domain signal on the second sound channel, and the time-domain signal on the first sound channel and the time-domain signal on the second sound channel are corresponding to a same time period; and determining the target search range according to the target search complexity, the reference parameter, and a limiting value $T_{max}$, wherein the limiting value $T_{max}$ is determined according to a sampling rate of the time-domain signal on the first sound channel, and the target search range falls within[$-T_{max}$, 0], or the target search range falls within[0, $T_{max}$].

6. The method according to claim 5, wherein the determining a reference parameter according to a time-domain signal on the first sound channel and a time-domain signal on the second sound channel comprises:

performing cross-correlation processing on the time-domain signal on the first sound channel and the time-domain signal on the second sound channel, to determine a first cross-correlation processing value and a second cross-correlation processing value, wherein the first cross-correlation processing value is a maximum function value, within a preset range, of a cross-correlation function of the time-domain signal on the first sound channel relative to the time-domain signal on the second sound channel, and the second cross-correlation processing value is a maximum function value, within the preset range, of a cross-correlation function of the time-domain signal on the second sound channel relative to the time-domain signal on the first sound channel; and determining the reference parameter according to a value relationship between the first cross-correlation processing value and the second cross-correlation processing value.

7. The method according to claim 6, wherein the reference parameter is an index value corresponding to a larger one of the first cross-correlation processing value and the second cross-correlation processing value, or an opposite number of the index value.

8. The method according to claim 5, wherein the determining a reference parameter according to a time-domain signal on the first sound channel and a time-domain signal on the second sound channel comprises:

performing peak detection processing on the time-domain signal on the first sound channel and the time-domain signal on the second sound channel, to determine a first index value and a second index value, wherein the first index value is an index value corresponding to a maximum amplitude value of the time-domain signal on the first sound channel within a preset range, and the second index value is an index value corresponding to a maximum amplitude value of the time-domain signal on the second sound channel within the preset range; and determining the reference parameter according to a value relationship between the first index value and the second index value.

9. The method according to claim 1, wherein the method further comprises:

performing smoothing processing on the first ITD parameter based on a second ITD parameter, wherein the first ITD parameter is an ITD parameter in a first time period, the second ITD parameter is a smoothed value of an ITD parameter in a second time period, and the second time period is before the first time period.

10. An apparatus for determining an inter-channel time difference parameter, the apparatus comprising:

a processor; and a memory storing a program to be executed in the processor, the memory comprising instructions for:

determining a target search complexity from a plurality of search complexities by directly searching a mapping entry for a channel quality value of a plurality of channel quality values, wherein the mapping entry is a mapping relationship between the plurality of search complexities and a plurality of channel quality values, and wherein the plurality of search complexities are in a one-to-one correspondence with the plurality of channel quality values, and performing search processing on a signal on a first sound channel and a signal on a second sound channel according to the target search complexity so as to determine a first inter-channel time difference (ITD) parameter corresponding to the first sound channel and the second sound channel.

11. The apparatus according to claim 10, wherein the determining a target search complexity comprises further instructions for:

obtaining a coding parameter for a stereo signal, wherein the stereo signal is generated based on the signal on the first sound channel and the signal on the second sound channel, the coding parameter is determined according to a current channel quality value, and the coding parameter comprises any one of the following parameters: a coding bit rate, a coding bit quantity, or a complexity control parameter used to indicate a search complexity; and determining the target search complexity from the plurality of search complexities according to the coding parameter.

12. The apparatus according to claim 10, wherein the plurality of search complexities are in a one-to-one correspondence with a plurality of search steps, the plurality of search complexities comprise a first search complexity and a second search complexity, the plurality of search steps comprise a first search step and a second search step, the first search step corresponding to the first search complexity is less than the second search step corresponding to the second search complexity, and the first search complexity is higher than the second search complexity; and the performing search processing comprises further instructions for:

determining a target search step corresponding to the target search complexity; and performing search processing on the signal on the first sound channel and the signal on the second sound channel according to the target search step.

13. The apparatus according to claim 10, wherein the plurality of search complexities are in a one-to-one correspondence with a plurality of search ranges, the plurality of search complexities comprise a third search complexity and a fourth search complexity, the plurality of search ranges comprise a first search range and a second search range, the first search range corresponding to the third search complexity is greater than the second search range corresponding to the fourth search complexity, and the third search complexity is higher than the fourth search complexity; and the performing search processing comprises further instructions for:

determining a target search range corresponding to the target search complexity; and performing search processing on the signal on the first sound channel and the signal on the second sound channel within the target search range.

14. The apparatus according to claim 13, wherein the performing search processing comprises further instructions for:

determining a reference parameter according to a time-domain signal on the first sound channel and a time-domain signal on the second sound channel, wherein the reference parameter is corresponding to a sequence of obtaining the time-domain signal on the first sound channel and the time-domain signal on the second sound channel, and the time-domain signal on the first sound channel and the time-domain signal on the second sound channel are corresponding to a same time period; and determining the target search range according to the target search complexity, the reference parameter, and a limiting value $T_{max}$, wherein the limiting value $T_{max}$ is determined according to a sampling rate of the time-domain signal on the first sound channel, and the target search range falls within $[-T_{max}, 0]$, or the target search range falls within $[0, T_{max}]$.

15. The apparatus according to claim 14, wherein the performing search processing comprises further instructions for:

performing cross-correlation processing on the time-domain signal on the first sound channel and the time-domain signal on the second sound channel, to determine a first cross-correlation correlation processing value and a second cross-correlation processing value, wherein the first cross-correlation processing value is a maximum function value, within a preset range, of a cross-correlation function of the time-domain signal on the first sound channel relative to the time-domain signal on the second sound channel, and the second cross-correlation processing value is a maximum function value, within the preset range, of a cross-correlation function of the time-domain signal on the second sound channel relative to the time-domain signal on the first sound channel; and determining the reference parameter according to a value relationship between the first cross-correlation processing value and the second cross-correlation processing value.

16. The apparatus according to claim 15, wherein the reference parameter is an index value corresponding to a larger one of the first cross-correlation processing value and the second cross-correlation processing value, or an opposite number of the index value.

17. The apparatus according to claim 14, wherein the performing search processing comprises further instructions for:

performing peak detection processing on the time-domain signal on the first sound channel and the time-domain signal on the second sound channel, to determine a first index value and a second index value, wherein the first index value is an index value corresponding to a maximum amplitude value of the time-domain signal on the first sound channel within a preset range, and the second index value is an index value corresponding to a maximum amplitude value of the time-domain signal on the second sound channel within the preset range; and determining the reference parameter according to a value relationship between the first index value and the second index value.

18. The apparatus according to claim 10, wherein the performing search processing comprises further instructions for:

performing smoothing processing on the first ITD parameter based on a second ITD parameter, wherein the first ITD parameter is an ITD parameter in a first time period, the second ITD parameter is a smoothed value of an ITD parameter in a second time period, and the second time period is before the first time period.

19. A method for determining an inter-channel time difference parameter, the method comprising:

determining a target search complexity from a plurality of search complexities, wherein the plurality of search complexities are in a one-to-one correspondence with a plurality of channel quality values; and performing search processing on a signal on a first sound channel and a signal on a second sound channel according to the target search complexity by determining a target search range corresponding to the target search complexity according to the target search complexity and a limiting value $T_{max}$ so as to determine a first inter-channel time difference (ITD) parameter corresponding to the first sound channel and the second sound channel, wherein the limiting value $T_{max}$ is determined according to a sampling rate of a time-domain signal on the first sound channel, and the target search range falls within $[-T_{max}, 0]$, or the target search range falls within $[0, T_{max}]$.

20. The method according to claim 19, wherein the plurality of search complexities comprises three search complexities, and wherein the target search range falls within $[-T_{max}, -T_{max}/2]$, or the target search range falls within $[-T_{max}/2, 0]$, or the target search range falls within $[0, T_{max}/2]$, or the target search range falls within $[T_{max}/2, T_{max}]$.

* * * * *